US005518764A

United States Patent [19]

Träubel et al.

[11] Patent Number: 5,518,764

[45] Date of Patent: May 21, 1996

[54] PROCESS FOR COATING TEXTILES

[75] Inventors: Harro Träubel, Leverkusen; Martin Reiner, Plochingen; Rolf Langel; Hans-Albert Ehlert, both of Leverkusen, all of Germany

[73] Assignee: Bayer Aktiengesellschaft, Leverkusen, Germany

[21] Appl. No.: 401,596

[22] Filed: Mar. 9, 1995

[30] Foreign Application Priority Data

Mar. 22, 1994 [DE] Germany ..... 44 09 688.7

[51] Int. Cl.[6] ..... B05D 1/00; B05D 5/00

[52] U.S. Cl. ..... 427/209; 427/389.9; 428/264; 428/265

[58] Field of Search ..... 427/209, 389.9; 428/264, 265

[56] References Cited

U.S. PATENT DOCUMENTS

| | | | |
|---|---|---|---|
| 3,188,353 | 6/1965 | Holtschmidt | 260/615 |
| 3,635,870 | 1/1972 | Thoma et al. | 260/30.8 |
| 3,640,937 | 2/1972 | Thoma et al. | 260/30.8 |
| 3,640,967 | 2/1972 | König et al. | 260/77.5 |
| 3,658,746 | 4/1972 | Rosendahl et al. | 260/30.8 DS |
| 3,989,870 | 11/1976 | Bocks et al. | 428/315 |
| 4,108,814 | 8/1978 | Reiff et al. | 260/29.2 TN |
| 4,237,264 | 12/1980 | Noll et al. | 528/67 |
| 4,430,380 | 2/1984 | Honel et al. | 427/389.9 |
| 4,510,302 | 4/1985 | Kolb et al. | 526/264 |
| 4,808,691 | 2/1989 | König et al. | 528/76 |
| 4,880,673 | 11/1989 | Tork et al. | 427/412 |
| 5,200,489 | 4/1993 | Jacobs et al. | 528/49 |

FOREIGN PATENT DOCUMENTS

| | | |
|---|---|---|
| 4217716 | 12/1993 | Germany . |
| 1515868 | 6/1978 | United Kingdom . |
| 2255780 | 11/1992 | United Kingdom . |

*Primary Examiner*—Michael Lusignan
*Attorney, Agent, or Firm*—Joseph C. Gil; Richard E. L. Henderson

[57] ABSTRACT

The present invention relates to the preparation of coated textile fabrics using an aqueous binder dispersion containing (A) 100 parts by weight of a polymeric binder (calculated as solid) and (B) additives comprising, per 100 parts by weight of binder (A), (i) about 3 to about 12 parts by weight of fat, oil, and/or wax, and (ii) about 50 to about 100 parts by weight of cellulose.

2 Claims, No Drawings

PROCESS FOR COATING TEXTILES

BACKGROUND OF THE INVENTION

The present invention relates to a process for the preparation of coated textile fabrics with an aqueous dispersion of an organic binder in the presence of certain additives.

For the purposes of the invention, the term "coating" includes binding that requires complete impregnation of the textile fabric with the binder dispersion.

The production of coated textile fabrics, such as artificial leather, has long been known. One or more layers of the coating-agent are applied to the substrate using either a direct coating process or a transfer process. The coated textile fabrics may be used for the production of outer clothing, shoe upper material and linings, bag-making and upholstery material, tenting, tarpaulins, conveyor belts, and the like.

In the production of high quality coated textile fabrics, flexibility, tensile strength, and softness are, inter alia, of vital significance. Stiff fabrics are rejected by customers as uncomfortable.

It has been found important to avoid bonding fiber crossing points when producing flexible coated textile fabrics to avoid a loss of flexibility and the risk that the bond between the textile fibers and binder will be broken under flexural stress.

The undesired bonding of fiber crossing points may be avoided if the textile fabric is treated with aqueous dispersions of organic binders that are then coagulated. Coated textile fabrics produced in this manner are characterized by increased tensile strength and greater softness.

Various methods of coagulation are known, with the essential ones being the following:

(1) Bath coagulation, in which the substrate is coated with a binder dissolved in an organic solvent (for example DMF, DMSO, or THF) and the resultant product is passed through a bath of a non-solvent that is miscible with the solvent (for example, water). Coagulation occurs due to extraction of the solvent by the non-solvent.

(2) Evaporation coagulation, which is based upon the use of a volatile solvent and a less volatile non-solvent for the binder. Under careful heating, the solvent is preferentially evaporated, so that the binder coagulates due to the constantly increasing proportion of non-solvent.

(3) Salt coagulation, in which the coated substrate is introduced into a concentrated salt solution and the binder is coagulated by the high electrolyte content (i.e., it is virtually "salted out").

(4) The prepolymer method, in which a substrate coated with an isocyanate propolymer is immersed in water, thereby yielding a polyurea having a porous structure with elimination of $CO_2$.

(5) Coagulation by means of temperature increase, which is possible for heat-sensitive binders.

These methods have the disadvantage of requiring long periods for complete removal of the solvent, considerable effort for the separation and recovery of solvent and non-solvent, or the disposal of salt-laden effluents, or of giving results that are not always acceptable in terms of quality.

The object of the present invention was thus to provide a process for coating textiles without the stated disadvantages whereby a high quality product may be obtained using an aqueous dispersion and the lowest possible organic solvent content without the use of salt baths.

It has surprisingly been found that this object may be achieved by using an aqueous binder dispersion based on at least one polymer in the presence of certain additives.

SUMMARY OF THE INVENTION

The present invention thus relates to a process for the preparation of a coated textile fabric comprising applying to said textile fabric a low-solvent, aqueous binder dispersion comprising (A) 100 parts by weight of a polymeric binder (calculated as solid) and (B) additives comprising, per 100 parts by weight of binder (A), (i) about 3 to about 12 parts by weight of fat, oil, and/or wax, and (ii) about 50 to about 100 parts by weight of cellulose.

DETAILED DESCRIPTION OF THE INVENTION

For the purposes of the present invention, textile fabrics include, for example, woven fabrics, knitted fabrics, and bonded and unbonded non-wovens. The textile fabrics may be made from synthetic and/or natural fibers. In principle, textiles made from any desired fibers are suitable for the process according to the invention.

Suitable polymeric binders (A) include, for example, polybutadienes, polyacrylates, polyurethanes, polyvinyl acetates, and vinyl chloride/vinyl acetate copolymers.

For the purposes of this invention, polybutadienes (A) include polymers of optionally substituted butadienes with 4 to 9 carbon atoms per molecule, such as 1,3-butadiene, isoprene, 2,3-dimethyl-1,3-butadiene, 2-neopentyl-1,3-butadiene, chloroprene, 2-cyano-1,3-butadiene, and mixtures thereof (1,3-butadiene being particularly preferred).

Particularly preferred polybutadienes (A) are polymers prepared using (1) 1 to 10 parts by weight of one or more α,β-monoethylenically unsaturated aliphatic carboxylic acids with 2 to 12 carbon atoms and (2) 90 to 99 parts by weight of a mixture of (a) 10 to 90 parts by weight (preferably 30 to 70 parts by weight) of optionally substituted butadiene and (b) 10 to 90 parts by weight (preferably 30 to 70 parts by weight) of one or more vinyl aromatics with 8 to 12 carbon atoms and/or (meth)acrylonitrile, wherein the quantity of (meth)acrylonitrile in the mixture is no more than 50 parts by weight Examples of α,β-monoethylenically unsaturated mono- and dicarboxylic acids (1) include acrylic acid, methacrylic acid, itaconic acid, fumaric acid, and maleic acid together with monoesters of these dicarboxylic acids having 1 to 8 carbon atoms in the alcohol component, such as monoalkyl itaconate, fumarate, and maleate.

Suitable vinyl aromatics (2)(b) are those in which the vinyl group is directly attached to the ring consisting of 6 to 10 carbon atoms. Examples of vinyl aromatics include styrene and substituted styrenes such as 4-methylstyrene, 3-methylstyrene, 2,4-dimethylstyrene, 4-isopropylstyrene, 4-chlorostyrene, 2,4-dichlorostyrene, divinylbenzene, α-methylstyrene and vinylnaphthalene. Styrene is preferred.

Up to 25 parts by weight of the monomers (2) may be replaced by one or more copolymerizable monomers, particularly by (meth)acrylic acid alkyl esters, such as methyl, ethyl, propyl, isopropyl, butyl, isobutyl, and 2-ethylhexyl (meth)acrylate; mono- and diesters prepared from alkanediols and α,β-monoethylenically unsaturated monocarboxylic acids, such as ethylene glycol mono(meth)acrylate, propylene glycol mono(meth)acrylate, ethylene glycol di(meth)acrylate, and 1,4-butanediol di(meth)acrylate; amides of α,β-monoethylenically unsaturated mono- and dicarboxylic acids, such as acrylamide and methacrylamide and the N-methylol compounds thereof, together with N-alkoxymethyl(meth)acrylamides and N-acyl(meth)acrylamides having 1 to 4 carbon atoms in the alkyl groups such as N-methoxymethyl(meth)acrylamide, N-butoxymethyl-(meth)acrylamide and N-acetoxymethyl(meth)acrylamide. Monomers bearing sulfonic acid groups are also suitable, such as styrenesulfonic acid, (meth)allylsulfonic acid, or the water-soluble salts thereof. Further comonomers which may be considered are vinyl esters of carboxylic acids having 1 to 18 carbon atoms, particularly vinyl acetate and vinyl propionate, vinyl chloride, and vinylidene chloride; vinyl ethers such as vinyl methyl ether; vinyl ketones such as vinyl ethyl ketone; and heterocyclic monovinyl compounds such as vinyl pyridine.

For the purposes of the invention, polyacrylates (A) include polymers based on monomers consisting entirely or partially of acrylic acid and/or methacrylic acid $C_1$–$C_{12}$ alkyl esters. Preferred polyacrylates (A) have number average molecular weights of about 500 to about 2000 (preferably 500 to 1600) and Shore A hardnesses of 11 to 99 (preferably 20 to 80, more preferably 20 to 60).

Preferred polyacrylates (A) are polymers prepared from (a) acrylic acid $C_1$–$C_{12}$ alkyl esters and/or methacrylic acid $C_1$–$C_{12}$ alkyl esters such as methyl acrylate, ethyl acrylate and methacrylate, butyl acrylate and methacrylate, and 2-ethylhexyl acrylate and methacrylate, (b) optionally, α,β-monoethylenically unsaturated mono- and/or dicarboxylic acids such as acrylic acid, methacrylic acid, and maleic acid semi-esters with up to 8 carbon atoms in the alcohol component, (c) optionally, acrylonitrile, (d) optionally, methyl methacrylate, styrene, chlorine-substituted, or $C_1$–$C_4$ alkyl-substituted styrene such as α-methylstyrene, o-chlorostyrene, p-chlorostyrene, o-, m-or p-methylstyrene, p-tert-butylstyrene, and (e) optionally, other monomers, such as, for example, vinyl acetate, acrylamide, methacrylamide, hydroxy-$C_2$–$C_4$ alkyl acrylate and methacrylate, such as 2-hydroxyethyl acrylate and methacrylate, 2-hydroxypropyl acrylate and methacrylate, 2-hydroxybutyl acrylate and methacrylate.

Preferred quantities for the individual groups of monomers for such polyacrylates are 10 to 100 wt. % of (a), optionally 0.5 to 20 wt. % of (b), optionally 1 to 30 wt. % of (c), 0 to 60 wt. % of (d), and 0 to 50 wt. % of (e), wherein the percentages each relate to the total of the monomers polymerized in the polyacrylate (A).

These and similar polyacrylates are, for example, described in German Offenlegungsschriften 2,460,329 and 3,610,576.

For the purposes of the invention, the term "polyurethanes" also includes polyurethaneureas and polyureas.

Polyurethanes (A) may be prepared in a known manner in a melt or, preferably, in an organic solvent.

Polyisocyanates of the formula $Q(NCO)_2$ are used for synthesis of the polyurethanes (A), wherein Q denotes an aliphatic hydrocarbon residue with 4 to 12 carbon atoms, a cycloaliphatic hydrocarbon residue with 6 to 25 carbon atoms, an aromatic hydrocarbon residue with 6 to 15 carbon atoms, or an araliphatic hydrocarbon residue with 7 to 15 carbon atoms. Examples of preferred diisocyanates include tetramethylene diisocyanate, hexamethylene diisocyanate, dodecamethylene diisocyanate, 1,4-diisocyanatocyclohexane, 3-isocyanatomethyl-3,3,5-trimethylcyclohexyl isocyanate (i.e., isophorone diisocyanate), 4,4'-diisocyanatodicyclohexylmethane, 4,4'-diisocyanato-3,3'-dimethyldicyclohexylmethane, 4,4'-diisocyanato- 2,2-dicyclohexylpropane, 1,4-diisocyanatobenzene, 1,4- or 2,6-diisocyanatotoluene or mixtures of these isomers, 4,4'-, 2,4'- or 2,2'-diisocyanatodiphenylmethane or mixtures of the isomers, 4,4'-diisocyanato- 2,2-diphenylpropane, p-xylylene diisocyanate, and α,α,α',α'-tetramethyl-m- or -p-xylylene diisocyanate, together with mixtures containing these compounds.

It is, of course, also possible to use the more highly functional polyisocyanates known in polyurethane chemistry or known modified polyisocyanates, for example, polyisocyanates having carbodiimide groups, allophanate groups, isocyanurate groups, urethane groups, and/or biuret groups.

Isocyanate-reactive compounds for reaction with the polyisocyanates are principally polyhydroxyl compounds which have 2 to 8 (preferably 2 or 3) hydroxyl groups per molecule and an (average) molecular weight of up to about 5,000 (preferably of up to 2,500). Both low molecular weight polyhydroxyl compounds having molecular weights of 32 to 349 and higher molecular weight polyhydroxyl compounds having average molecular weights of at least 350 (preferably at least 1,000) may be considered for this purpose.

Higher molecular weight polyhydroxyl compounds include the hydroxypolyesters, hydroxypolyethers, hydroxypolythioethers, hydroxypolyacetals, hydroxypolycarbonates, and/or hydroxypolyesteramides that are known in polyurethane chemistry, preferably such compounds having average molecular weights of 600 to 4,000, more preferably those with average molecular weights of 800 to 2,500. Polycarbonate polyols, polyether polyols, and polyester polyols are particularly preferred.

Components suitable for the introduction of polyethylene oxide units in the synthesis of the polyurethanes (A) include homopolyethylene glycols and ethylene oxide mixed polyethers with hydroxyl terminal groups (preferably ethylene oxide/propylene oxide mixed ethers) having a block or random distribution, preferably polyether carbonates and polyether esters based on the above-stated homopolyethylene glycols, ethylene oxide mixed polyethers or mixtures thereof with other polyhydroxyl compounds that form polycarbonates or polyesters.

The optimum quantity of the polyethylene oxide units in the polyurethane (A) is somewhat dependent upon the sequence length and obeys the general rule that the quantity may be somewhat greater for shorter sequence lengths and somewhat less for longer sequence lengths. For example, while at a sequence length of 2 the content of these polyethylene oxide units in the polyurethane (A) may be, for example, up to 50 wt. %, for a sequence length of over 20, it is generally recommended to restrict the content of polyethylene oxide units in the polyurethane (A) to 20 wt. %.

In order to promote the dispersing action, monofunctional polyethylene oxide alcohols (i.e., ethoxylated monohydric alcohols or ethoxylated phenols) may be incorporated into the polyurethane (A) in quantities of 0.2 to 5 wt. %, relative to polyurethane (A). The proportion of such monofunctional polyethylene oxide units in polyurethane (A) should not exceed 30 wt. % (preferably 20, more preferably 10 wt. %) relative to the quantity of the total incorporated polyethylene oxide units. However, the best results are obtained if no monofunctional polyethylene oxide units are incorporated.

Thus, the starting components for the polyurethanes (A) that yield the polyethylene oxide units primarily comprise ethylene oxide polyethers and ethylene oxide/propylene oxide mixed polyethers having 2 or 3 hydroxyl groups with a predominant proportion by weight of ethylene oxide units. Pure ethylene oxide polyethers are preferred.

For the purposes of the invention, the term "average molecular weights" means molecular weights determined as a number average.

The compounds used in addition to the compounds yielding polyethylene oxide units may be selected from those compounds customary in polyurethane chemistry that are capable of reacting with isocyanate groups.

Polyhydroxyl components are described below that are suitable as polyurethane synthesis components but which contain no polyethylene oxide units.

Suitable polycarbonates containing hydroxyl groups can be obtained by the reaction of carbonic acid derivatives, for example, diphenyl carbonate or phosgene, with diols. Suitable diols include, for example,-ethylene glycol, 1,2- and 1,3-propanediol, 1,4- and 1,3-butanediol, 1,6-hexanediol, 1,8-octanediol, neopentyl glycol, 1,4-bishydroxymethylcyclohexane, 2-methyl-1,3-propanediol, 2,2,4-trimethyl-1,3-pentanediol, dipropylene glycol, polypropylene glycols, dibutylene glycol, polybutylene glycols, bisphenol A, and tetrabromo-bisphenol A. The diol component preferably contains from 40 to 100 wt. % hexanediol (preferably 1,6-hexanediol) and/or hexanediol derivatives, preferably those having ether or ester groups in addition to terminal OH groups, for example, products obtained by reacting 1 mol of hexanediol with at least 1 mol (preferably I to 2 mol) of caprolactone according to German Offenlegungsschrift 1,770,245, or by etherification of hexanediol with itself to yield di- or trihexylene glycol. The preparation of such derivatives is known, for example from German Auslegeschrift 1,570,540. The polyether/polycarbonate diols described in German Offenlegungsschrift 3,717,060 may also very readily be used.

The hydroxypolycarbonates should be substantially linear but, if desired, may readily be branched by the incorporation of polyfunctional components, in particular low molecular weight polyols. Glycerol, trimethylolpropane, 1,2,6-hexanetriol, 1,2,4-butanetriol, trimethylolpropane, pentaerythritol, quinitol, mannitol and sorbitol, methyl glycoside, 1,4,3,6-dianhydrohexitols, for example, are suitable for this purpose.

Suitable polyether polyols are those polyethers known in polyurethane chemistry, such as the addition or mixed addition compounds of tetrahydrofuran, styrene oxide, propylene oxide, butylene oxides, or epichlorohydrin (particularly of propylene oxide) produced using divalent starter molecules such as water, the above-stated diols, or amines with two NH bonds.

Suitable polyester polyols include reaction products of polyhydric, preferably dihydric and optionally additionally trihydric, alcohols with polybasic, preferably dibasic carboxylic acids. Instead of the free polycarboxylic acids, it is also possible to use the corresponding polycarboxylic acid anhydrides or corresponding polycarboxylic acid esters of lower alcohols or mixtures thereof to produce the polyester. The polycarboxylic acids can be aliphatic, cycloaliphatic, aromatic, and/or heterocyclic and can optionally be substituted (for example, with halogen atoms) and/or unsaturated.

Examples of suitable polycarboxylic acids and derivatives thereof include succinic acid, adipic acid, suberic acid, azelaic acid, sebacic acid, phthalic acid, isophthalic acid, trimellitic acid, phthalic anhydride, tetrahydrophthalic anhydride, hexahydrophthalic anhydride, tetrachlorophthalic anhydride, endomethylenetetrahydrophthalic anhydride, glutaric anhydride, maleic acid, maleic anhydride, fumaric acid, dimeric and trimeric fatty acids such as oleic acid (optionally mixed with monomeric fatty acids), dimethyl terephthalate, and terephthalic acid bis-glycol ester.

Suitable polyhydric alcohols include ethylene glycol, 1,2- and 1,3-propanediol, 1,4-and 2,3-butanediol, 1,6-hexanediol, 1,8-octanediol, neopentyl glycol, cyclohexanedimethanol (i.e., 1,4-bis-hydroxymethylcyclohexane), 2-methyl-1,3-propanediol, glycerol, trimethylolpropane, 1,2,6-hexanetriol, 1,2,4-butanetriol, trimethylol-ethane, pentaerythritol, quinitol, mannitol and sorbitol, methyl glycoside, diethylene glycol, triethylene glycol, tetraethylene glycol, dipropylene glycol, dibutylene glycol, and polybutylene glycols.

Mixtures of the above-mentioned polyether polyols with polycarbonate polyols and/or polyester polyols having average molecular weights of 1,000 to 3,000 prepared from adipic acid, 1,6-hexanediol, and neopentyl glycol are also particularly preferred.

Chain extenders having molecular weights of 32 to 299 and having 1 to 4 hydroxyl and/or amino groups are also particularly suitable as further components for the synthesis of the polyurethanes (A).

Low molecular weight polyhydroxyl compounds ("chain extenders") include the most varied types of diols, such as the following:

(a) alkane diols, such as ethylene glycol, 1,2- and 1,3-propanediol, 1,4-butanediol, 1,5-pentanediol, dimethyl-1,3-propanediol, and 1,6-hexanediol;

b) ether diols, such as diethylene glycol, triethylene glycol, or hydroquinone dihydroxyethyl ether;

c) ester diols of the general formulas $$HO—(CH_2)_x—CO—O—(CH_2)_y—OH$$

and $$HO—(CH_2)_x—O—CO—R—CO—O—(CH_2)_x—OH$$

in which

R represents an alkylene or arylene residue with 1 to 10 (preferably 2 to 6) carbon atoms, x is 2 to 6, and y is 3 to 5, such as δ-hydroxybutyl-ε-hydroxycaproic acid ester, ω-hydroxyhexyl-γ-hydroxybutyric acid ester, adipic acid (β-hydroxyethyl) ester and terephthalic acid bis(β-hydroxyethyl) ester.

Polyamines may, however, also be used as chain extenders. Polyamine chain extenders are preferably aliphatic or cycloaliphatic diamines, although trifunctional or more highly functional polyamines may optionally also be used to achieve a certain degree of branching. Examples of suitable aliphatic polyamines include ethylenediamine, 1,2- and 1,3-propylenediamine, 1,4-tetramethylenediamine, 1,6-hexamethylenediamine, an isomer mixture of 2,2,4- and 2,4,4-trimethylhexamethylenediamine, 2-methylpentamethylenediamine and bis-(β-aminoethyl)amine (i.e., diethylenetriamine).

Examples of suitable cycloaliphatic polyamines include

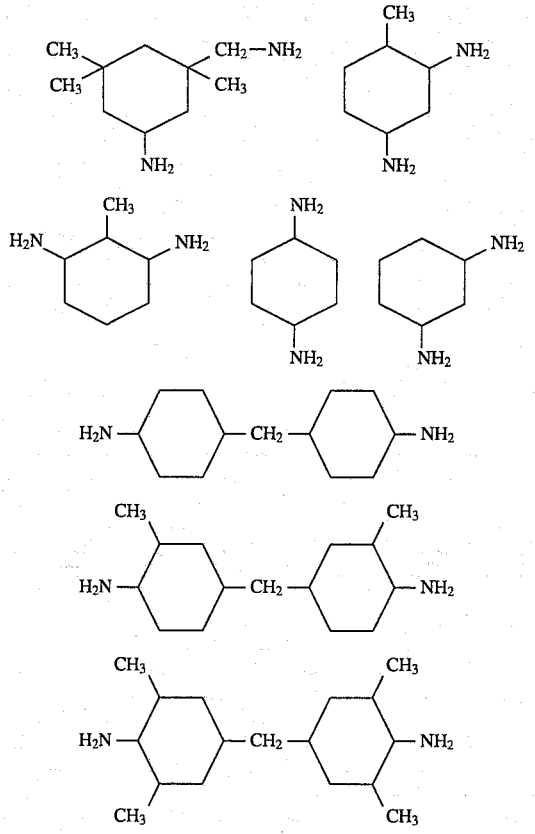

Araliphatic polyamines, such as 1,3- and 1,4-xylylenediamine or α,α,α',α'-tetramethyl-1,3- and -1,4-xylylenediamine, may also be used as chain extenders for preparation of the polyurethanes (A).

For the purposes of the invention, hydrazine, hydrazine hydrate, and substituted hydrazines should also be considered as diamines. Examples of suitable substituted hydrazines include methylhydrazine, N,N'-dimethylhydrazine and the homologs thereof, together with acid dihydrazides, such as carbodihydrazide, oxalic acid dihydrazide, the dihydrazides of malonic acid, succinic acid, glutaric acid, adipic acid, β-methyladipic acid, sebacic acid, hydracrylic acid, and terephthalic acid, semicarbazido alkylene hydrazides, such as for example G-semicarbazidopropionic acid hydrazide (German Offenlegungsschrift 1,770.591), semicarbazidoalkylene carbazine esters, such as 2-semicarbazidoethyl carbazine ester (German Offenlegungsschrift 1,918,504) or aminosemicarbazide compounds, such as β-aminoethyl semicarbazido carbonate (German Offenlegungsschrift 1,902,931).

Ionic groups for the polyurethanes (A) include alkali and ammonium carboxylate and sulfonate groups, together with ammonium groups. Suitable components for introducing such groups into the polyurethanes (A) consequently include dihydroxycarboxylic acids, diaminocarboxylic acids, dihydroxylsulfonic acids together with diaminoalkylsulfonic acids and the salts thereof, such as dimethyiolpropionic acid, ethylenediamine-β-ethylsulfonic acid, ethylenediaminepropyl- or -butylsulfonic acid, 1,2- or 1,3-propylene-diamine-β-ethylsulfonic acid, lysine, 3.5-diaminobenzoic acid, and the alkali and/or ammonium salts thereof, as well as the addition product of sodium bisulfite and 2-butene-1,4-diol.

Aliphatic diols containing sulfonate groups according to German Offenlegungsschrift 2,446,440 of the following formula are particularly preferred components for introducing the ionic groups into the polyurethanes (A):

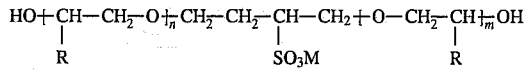

in which

R represents hydrogen or an organic residue with 1 to 8 carbon atoms,

M represents ammonium or an alkali metal cation, and m and n are numbers from 1 to 10.

Examples of (potentially) cationic synthesis components are diols containing tertiary amino groups, such as N-methyldiethanolamine or the protonation or alkylation products thereof.

In very general terms, cationic and/or anionic hydrophilic difunctional synthesis components of the type described for the preparation of aqueous polyurethane dispersions may be used as components to introduce the ionic groups into the polyurethanes (A). Examples of such compounds include dihydroxyl compounds, dihydroxyldiamines, or dihydroxyldiisocyanates containing (potentially) ionic groups.

Suitable polyurethanes (A) are described, for example, in German Patentschriften 2,231,411 and 2,651,506.

According to a preferred embodiment, suitable polyurethanes (A) are those containing both incorporated polyethoxy groups and ionic groups, particularly polyurethanes (A) containing terminal polyalkylene oxide chains with an ethoxy group content of 0.5 to 10 wt. %, relative to the polyurethane (A), and 0.1 to 15 milliequivalents of ammonium, sulfonium, carboxylate, and/or sulfonate groups per 100 g of polyurethane (A).

Polyacrylates and polyurethanes, together with blends thereof, are particularly preferred as the binder (A).

The additives (B)(i) include fats, oils, and waxes of vegetable, animal, and synthetic origin, preferably mixtures of fatty acids and sulfonated fatty acids such as those produced by the industrial sulfonation of triglycerides, neatsfoot oil, Turkey-red oil, silicone oils, waxes and paraffins with softening points from 30° to 120° C. (preferably 40° to 100° C.).

The additives (B)(i) may be used in a form known from leather dressing, that is, as an aqueous preparation containing (in each case related to the preparation):

5 to 50 wt. % component (B)(i), 1 to 50 wt. % viscosity regulator (thickener), such as montmorillonite, bentonite, polyacrylic acid, polyethylene oxide, casein, up to 30 wt. % filler or flatting agent, such as chalk or mica, 1 to 20 wt. % emulsifier, for example, based on neutralized oleic and/or stearic acid, alkyl polyglycol ethers, nonylphenol polyethoxylates, or alkyl alcohol polyalkoxylates, up to 80 wt. % organic binder, and balance water.

A list of products that may be used as additives may be found in Karsten, Lackrohstofftabellen, 8th edition, Hannover, 1987.

The cellulose provided as additive (B)(ii) is preferably used as a powder.

The aqueous binder dispersions to be used according to the invention generally contain 10 to 66 parts by weight of the total of components (A) and (B) and a quantity of water to make up to 100 parts by weight.

It is also possible to incorporate crosslinking additives which do not react with themselves or the binder (A) until the coating is complete, generally under the action of heat. These compounds include (some) etherified melamine-formaldehyde resins, such as hexamethylolmelamine, and optionally blocked polyisocyanates with 3 and more isocyanate groups, such as those based on tris(isocyanatohexyl) isocyanurate and tris(isocyantohexyl)biuret, polyepoxides, and polyaziridines. Polyisocyanates suitable as crosslinking agents include those described in German Offenlegungsschrift 4,136,618 and polyepoxides suitable as crosslinking agents are described in German Offenlegungsschrift 4,217,716.

The crosslinking agents may generally be used in quantities of up to 10 parts by weight (preferably of up to 5 parts by weight) per 100 parts by weight of the binder dispersion to be used according to the invention.

The binders to be used according to the invention may, of course, also contain colorants such as pigments and/or carbon black. The pigments may be used in a form customary in textiles coating or leather dressing, thus preferably as aqueous pigment preparations containing binder, such as those described in German Offenlegungsschriften 3,203,817 and 4,112,327. Depending upon the desired degree of opacity, 5 to 50 (preferably 12 to 25) parts by weight of aqueous pigment preparation may be used for each 100 parts by weight of the binder dispersion according to the invention.

The coated textile fabrics obtained according to the invention may also be subsequently dyed using known methods.

The binder dispersions to be used according to the invention may be applied, for example, by pouring, spraying, dipping, with a coating knife or roller, or in a padding machine.

In general, the binder dispersion is dried after application, preferably at temperatures of 60° to 150° C. (more preferably 80° to 120° C.). The substrate provided with the binder dispersion according to the invention may also be pre-dried to a residual moisture content of 20 to 50% and a top coat, preferably based on the polyacrylates or polyurethanes described above under (A), may then be applied using a direct or reversal process.

The textile fabrics coated on one or both sides may subsequently be gently sanded and are then particularly soft. It may also be advantageous to dry the substrate coated with the binder dispersion to be used according to the invention directly without intensive pre-drying, for example, using a stenter drier. Mechanical treatment in a tumbler also increases softness.

The following examples further illustrate details for the process of this invention. The invention, which is set forth in the foregoing disclosure, is not to be limited either in spirit or scope by these examples. Those skilled in the art will readily understand that known variations of the conditions of the following procedures can be used. Unless otherwise noted, all temperatures are degrees Celsius and all parts and percentages are parts by weight and percentages by weight, respectively.

EXAMPLES

Components used:

- ACRAFIX® MF: N-methylolmethylmelamine-based crosslinking agent from Bayer AG, Leverkusen
- ARBOCEL® BE 600–30: cellulose powder from Rettenmeier & Söhne, Ellwangen-Holzmühle
- BAYGARD® 40140: polyurethane-based textile auxiliary for water and oil repellent finishes from Bayer AG, Leverkusen
- BAYPRET® USV: Anti-felting finish for wool, 30% aqueous solution of a polyether-based sulfite-blocked oligourethane isocyanate from Bayer AG, Leverkusen
- EMULSIFIER VA: Polyether-based emulsifier from Bayer AG, Leverkusen
- EUDERM® Grund 25 A: 40% aqueous dispersion of a polyacrylate with a Shore A hardness of 25; manufacturer: Bayer AG, Leverkusen
- EUDERM® Nappasoft S: wax-based aqueous dressing from Bayer AG, Leverkusen
- EUDERM® Soft FD 7927: oil/wax-based aqueous leather dressing from Bayer AG, Leverkusen
- EUDERM® Soft-Filler VF: silicone oil-based aqueous leather dressing from Bayer AG, Leverkusen
- EUDERM® White D-CG: pigment preparation from Bayer AG, Leverkusen
- EUDERM® Red B: pigment preparation from Bayer AG, Leverkusen
- IMPRANIL® Dispersion DLP: 50% aqueous dispersion of an aliphatic polyurethane with a Shore A hardness of 58; manufacturer: Bayer AG, Leverkusen
- IMPRANIL® Dispersion DLF: 40% aqueous dispersion of an aliphatic polyurethane with a Shore A hardness of 95; manufacturer: Bayer AG, Leverkusen
- IMPRANIL® Dispersion DLV: 40% aqueous dispersion of an aliphatic polyurethane with a Shore A hardness of 65; manufacturer: Bayer AG, Leverkusen
- LEVAFIX® Brilliant Red E-4BA: red dye from Bayer AG, Leverkusen
- MIROX® AM: polyacrylic acid based thickener from Stockhausen GmbH, Krefeld
- PERSOFTAL® ASN: softener for cotton, 30% aqueous dispersion
- PERSOFTAL® SWA: softener for cotton, 50% aqueous dispersion of a polyether siloxane from Bayer AG, Leverkusen
- RESPUMIT® 3300: mineral oil based defoamer from Bayer AG, Leverkusen
- RHEOLATE® 205: polyether polyurethaneurea based thickener from Rheox Inc., Brussels

EXAMPLE 1

A mixture having a viscosity of 5600 mPa·s was prepared from 50 parts of EUDERM Grund 25 A, 50 parts of IMPRANIL Dispersion DLP, 20 parts of water together with 30 parts of EUDERM Nappasoft S, 30 parts of ARBOCEL BE 600–30, 2 parts of ACRAFIX MF and 1 part of MIROX AM. A woven cotton fabric, roughened on one side, was coated on both sides with an air blade (blade distance 2 mm). Take-up: 45 g/m$^2$ The coating was initially dried for 2 to 3 minutes at 80° C. and then for 2 minutes at 150° C. (in order to crosslink). The resultant woven fabric was somewhat rough feeling, but full-bodied. The woven fabric was then sanded on both sides with 320 grade paper. The resultant, full-bodied substrate had a round hand and felt very full.

A sample of the woven fabric produced in Example 1 was exhaust dyed with 2.2% of LEVAFIX Brilliant Red E-4BA at 50° C. The result was a brilliant red, evenly dyed sample

EXAMPLES 2 TO 6

The compositions of Examples 2 to 6 were prepared using the components listed in Table 1; the numbers represent parts by weight relative to the total composition.

TABLE 1

| | Examples | | | | |
|---|---|---|---|---|---|
| | 2 | 3 | 4 | 5 | 6 (comp) |
| IMPRANIL DLV | 50 | 50 | 50 | 50 | 50 |
| EUDERM Grund 25A | 50 | 50 | 50 | 50 | 50 |
| ARBOCEL BD 600-30 | 20 | 20 | 20 | 20 | 50 |
| Water | 20 | 20 | 20 | 0 | 90 |
| EUDERM Nappasoft S | 30 | 0 | 0 | 0 | 0 |
| EUDERM Soft FD7927 | 0 | 30 | 0 | 0 | 0 |
| EUDERM Soft Filler VF | 0 | 0 | 30 | 0 | 0 |
| PERSOFTAL ASN | 0 | 0 | 0 | 60 | 60 |
| BAYGARD 40140 | 0 | 0 | 0 | 3 | 3 |
| MIROX AM; 25% in water + ammonia, adjusted to pH 9 | 3 | 2.5 | 1 | 3.5 | 0 |
| EMULSIFIER VA, 50% in water | 0 | 0 | 0 | 0 | 3 |
| Product take-up g/m$^2$ | 114 | 115 | 111 | 108 | 109 |

A woven cotton fabric, roughened on one side, was coated with an air blade. The coating was initially dried for 3 minutes at 80° C. and then for 2 minutes at 150° C. The woven fabric was then sanded once with 320 grade paper.

The following coating was then applied:

Top coat:

IMPRANIL Dispersion DLV 700 parts

IMPRANIL Dispersion DLF 300 parts

RESPUMIT 3300 (dissolved 1:2 3 parts in toluene)

EUDERM White D-CG 80 parts

EUDERM Red B 50 parts

MIROX AM (25% in water, 25 parts adjusted to pH 9 with ammonia)

PERSOFTAL SWA 50 parts

Coating weight: 24 g/m$^2$ (dry); Warren AUX smooth mat release paper

Coupling coat:

IMPRANIL DLP dispersion 1000 parts

RHEOLATE 205, 5% in water 30 parts

Coating weight: 20 g/m$^2$

The dispersion of comparison Example 6 could not be processed, as it separated on impregnation.

The coated samples of Examples 2 to 5 were smooth and withstood 100,000 flexural cycles in the Bally Flexometer (to IUP 20).

EXAMPLES 7 TO 12

The compositions of Examples 7 to 12 were prepared using the components listed in Table 2; the numbers represent parts by weight relative to the total composition.

TABLE 2

| | Examples | | | | | |
|---|---|---|---|---|---|---|
| | 7 | 8 | 9 | 10 | 11 (Comp) | 12 (Comp) |
| IMPRANIL Dispersion DLP | 0 | 0 | 0 | 0 | 50 | 50 |
| IMPRANIL Dispersion DLV | 100 | 100 | 0 | 0 | 0 | 0 |
| BAYPRET USV | 0 | 0 | 100 | 100 | 0 | 0 |
| EUDERM Grund 25 A | 0 | 0 | 0 | 0 | 50 | 50 |
| EUDERM Nappasoft S | 30 | 0 | 30 | 0 | 30 | 0 |
| PERSOFTAL ASN | 0 | 60 | 0 | 60 | 0 | 0 |
| ARBOCEL BE 600-30 | 20 | 20 | 20 | 20 | 0 | 0 |
| BAYGARD 40140 | 0 | 3 | 0 | 3 | 0 | 0 |
| Water | 30 | 30 | 30 | 30 | 0 | 0 |
| Product up-take g/m$^2$ (dry) | 74 | 65 | 60 | 75 | 68 | 70 |
| Assessment after drying and sanding | v. soft full | v. soft full | soft full | v. soft full | less soft, less full | empty, flimsy |

Samples were finished in a padding machine and squeezed out twice; wet take-up was 100%. Drying was carried out for 3 minutes at 120° C. and 3 minutes at 150° C.

The sample from comparison Example 12 was not usable.

EXAMPLE 13

A fabric woven from ultra-fine polyester fiber was treated as in example 1. This fabric received an opaque, soft surface.

What is claimed is:

1. A process for the preparation of a coated textile fabric comprising applying to a textile fabric an aqueous binder dispersion comprising (A) 100 parts by weight of a polymeric binder, (B) additives comprising, per 100 parts by weight of binder (A), (i) 3 to 12 parts by weight of fat, oil, and/or wax and (ii) 50 to 100 parts by weight of cellulose, and (C) 0 to 10 parts by weight of a crosslinking agent other than binder (A) per 100 parts by weight of the aqueous binder dispersion, wherein the total of components (A) and (B) comprises 10 to 66 parts by weight per 100 parts by weight of the aqueous binder dispersion.

2. A process according to claim 1 wherein polymeric binder (A) is selected from the group consisting of polybutadienes, polyacrylates, polyurethanes, polyvinyl acetates, vinyl chloride/vinyl acetate copolymers, and mixtures thereof.

* * * * *